US009896754B2

(12) United States Patent
Hirayama et al.

(10) Patent No.: US 9,896,754 B2
(45) Date of Patent: Feb. 20, 2018

(54) ALUMINUM ALLOY SHEET EXCELLENT IN PRESS-FORMABILITY AND SHAPE FIXABILITY AND METHOD OF PRODUCTION OF SAME

(71) Applicant: NIPPON LIGHT METAL COMPANY, LTD., Tokyo (JP)

(72) Inventors: Tomoyuki Hirayama, Shizuoka (JP); Takeshi Handa, Shizuoka (JP); Toshiya Anami, Shizuoka (JP)

(73) Assignee: NIPPON LIGHT METAL COMPANY, LTD., Tokyo (JP)

( * ) Notice: Subject to any disclaimer, the term of this patent is extended or adjusted under 35 U.S.C. 154(b) by 281 days.

(21) Appl. No.: 14/387,157

(22) PCT Filed: Jan. 10, 2013

(86) PCT No.: PCT/JP2013/050327

§ 371 (c)(1),
(2) Date: Sep. 22, 2014

(87) PCT Pub. No.: WO2013/140826

PCT Pub. Date: Sep. 26, 2013

(65) Prior Publication Data

US 2015/0075677 A1 Mar. 19, 2015

(30) Foreign Application Priority Data

Mar. 21, 2012 (JP) ..... 2012-063167

(51) Int. Cl.

| | |
|---|---|
| ***C22C 21/08*** | (2006.01) |
| ***C22F 1/047*** | (2006.01) |
| ***C22C 21/06*** | (2006.01) |
| ***B22D 11/00*** | (2006.01) |
| *B22D 11/06* | (2006.01) |
| *B21B 3/00* | (2006.01) |

(52) U.S. Cl.

CPC ..... *C22F 1/047* (2013.01); *B22D 11/003* (2013.01); *C22C 21/06* (2013.01); *C22C 21/08* (2013.01); *B21B 2003/001* (2013.01); *B22D 11/06* (2013.01)

(58) Field of Classification Search

CPC ..... C22F 1/047; C22C 21/06; C22C 21/08; B22D 11/003; B22D 11/06; B21B 2003/001

See application file for complete search history.

(56) References Cited

U.S. PATENT DOCUMENTS

| | | | |
|---|---|---|---|
| 8,016,958 | B2 | 9/2011 | Zhao et al. |
| 8,425,698 | B2 | 4/2013 | Zhao et al. |
| 2007/0217943 | A1 | 9/2007 | Zhao et al. |
| 2009/0007994 | A1 | 1/2009 | Zhao et al. |
| 2009/0269613 | A1 | 10/2009 | Zhao et al. |

FOREIGN PATENT DOCUMENTS

| | | | |
|---|---|---|---|
| JP | 7278719 | A | 10/1995 |
| JP | 2005307300 | A | 11/2005 |
| JP | 2006219763 | A | 8/2006 |
| JP | 2007186741 | A | 7/2007 |
| JP | 2008024964 | A | 2/2008 |
| JP | 2008508421 | A | 3/2008 |
| JP | 2008163357 | A | 7/2008 |
| JP | 2008223054 | A | 9/2008 |
| WO | 2007080689 | A1 | 7/2007 |

OTHER PUBLICATIONS

Takahashi et al., English machine translation of JP 2008-223054, Sep. 2008, p. 1-15.*
International Search Report for PCT/JP2013/050327 dated Mar. 26, 2013.
English Abstract for JP-2007186741, Publication Date: Jul. 26, 2007.
English Abstract of JP-2008-163357, Publication Date: Jul. 17, 2008.
English Abstract of JP-2008223054, Publication Date: Sep. 25, 2008.
English Abstract of JP-2006219763, Publication Date: Aug. 24, 2006.
English Abstract of JPH07278716, Publication Date: Oct. 24, 1995.

* cited by examiner

*Primary Examiner* — Jessee Roe
(74) *Attorney, Agent, or Firm* — Millen, White, Zelano & Branigan, P.C.

(57) ABSTRACT

An aluminum alloy sheet which has high strength enabling application to automobile body sheet and which is excellent in press-formability and shape fixability and a method of production of the same are provided. Aluminum alloy sheet having a composition of ingredients which contains Mg, Fe, and Ti, restricts the impurity Si to less than 0.20 mass %, and has a balance of Al and unavoidable impurities and a metal structure with an average grain size of less than 15 μm and having second phase particles with a circle equivalent diameter of 3 μm or more in a number of less than 300/mm$^2$ and having a tensile strength of 240 MPa or more, a yield strength of less than 130 MPa, an elongation of 30% or more, and a plane strain fracture limit at a strain rate of 20/sec of 0.20 or more.

4 Claims, 1 Drawing Sheet

ALUMINUM ALLOY SHEET EXCELLENT IN PRESS-FORMABILITY AND SHAPE FIXABILITY AND METHOD OF PRODUCTION OF SAME

TECHNICAL FIELD

The present invention relates to aluminum alloy sheet which is excellent in press-formability which is used for automobile body panels etc. and a method of production of the same.

BACKGROUND ART

Al—Mg-based JIS 5000 series aluminum alloy sheet is excellent in strength and press-formability, so is being studied for application to automobile body panels etc. as an alternative material to steel sheet. To shape it to the desired form, it has to be shaped by a press die. 5000 series aluminum alloy sheet excellent in so-called press-formability has been developed. However, 5000 series aluminum alloy sheet is inferior to steel sheet in press-formability, so measures such as dividing parts into pieces for press-forming become necessary. The problem of the increase in number of parts and number of dies consequently arises. In particular, in press-forming of complicated shapes, cases are often seen of cracking and other defects occurring near the plane strain region.

Further improvement of the so-called plane strain fracture limit is therefore becoming a hot issue.

For example, PLT 1 describes aluminum alloy sheet for shaping use excellent in mechanical properties characterized by containing, by weight %, Mg: 2.0% to 6.0%, Si: 1.5% or less, and Fe: 1.5% or less, having a balance of Al and unavoidable impurities, and having remaining intermetallic compounds of an average size of 15 μm or less. According to this, if making the thickness of the slab which is cast 1 to 10 mm or so, the average size of the intermetallic compounds can be controlled to 15 μm or less and aluminum alloy sheet which is excellent in formability can be obtained.

On the other hand, PLT 2 discloses Al—Mg-based alloy sheet which has a texture with a volume fraction of the CUBE orientation of 30% to 50% and a volume fraction of the BRASS orientation of 10% to 20% and which has a grain size of 50 to 100 μm in range. According to this, by controlling the ratio of the individual crystal orientations for the texture, which governs the plastic anisotropy of aluminum alloy sheet, and by further optimizing the grain size and further by limiting the types and added amounts of the added elements, it is possible to obtain aluminum alloy sheet which is excellent in press-formability.

Recently, high strength aluminum alloy sheet which is provided with both the excellent skin roughness and formability which are suitable for structural materials of household electrical appliance products or automobile panels etc. and methods of production of the same have been proposed. PLT 3 describes high strength aluminum alloy sheet which has a chemical composition which contains Mg: 2.0 to 3.3 mass %, Mn: 0.1 to 0.5 mass %, and Fe: 0.2 to 1.0 mass %, has a balance of unavoidable impurities and Al, and, in the unavoidable impurities, has Si: less than 0.20 mass %, has an average circle equivalent diameter of intermetallic compounds of 1 μm or less, has an area rate of intermetallic compounds of 1.2% or more, and has an average size of recrystallized grains of 10 μm or less and a method of production of the same. According to this, Fe, in copresence with Mn and Si, causes the precipitation of fine Al—(Fe.Mn)—Si-based compounds at the time of casting, raises the strength, and improves the formability.

CITATIONS LIST

Patent Literature

PLT 1: Japanese Patent Publication No. 07-278716A
PLT 2: Japanese Patent Publication No. 2006-219763A
PLT 3: Japanese Patent Publication No. 2008-24964A

SUMMARY OF INVENTION

Technical Problem

It is true that in the production of 5000 series aluminum alloy sheet, if making the thickness of the original slab which is cast 1 to 10 mm or so, the average size of the intermetallic compounds can be controlled to 15 μm or less and aluminum alloy sheet which is excellent in formability can be obtained, but there is the problem that the amounts of Fe, Mn, and other transition elements forming solid solutions in the matrix rise and the final annealed sheet becomes high in yield strength, so the shape fixability falls. Further, regarding the plane strain fracture limit, tensile tests were used as the mainstream method of evaluation. Evaluation of the plane strain fracture limit at a stain rate of $10^{-2}$/sec or so was used as the general practice. However, in actual press-forming, the operation is expected to be performed at a strain rate of 10/sec or more. Aluminum alloy sheet which has an excellent formability even under tougher conditions has been desired. Therefore, with trend being made to apply 5000 series aluminum alloy sheet to body parts, particularly in press-forming of complicated shapes, it is expected that further improvements in the plane strain fracture limit will be demanded. There will be problems with direct application of thin slab continuous casting and cold rolled materials of the 5000 series. The present invention was made so as to solve this problem and has as its object the provision of JIS 5000 series aluminum alloy sheet which has high strength enabling application to automobile body sheets and which is excellent in formability and shape fixability even with a strain rate of a level equal to that at the time of actual press-forming and a method of production of the same.

Solution to Problem

The aluminum alloy sheet which is excellent in press-formability and shape fixability of the present invention, to achieve that object, is characterized by having a composition of ingredients which contains Mg: 3.4 to 5.5 mass %, Fe: 0.05 to 0.25 mass %, and Ti: 0.005 to 0.10 mass %, restricts the impurity Si to less than 0.20 mass %, and has a balance of Al and unavoidable impurities and a metal structure with an average grain size of less than 15 μm and having second phase particles with a circle equivalent diameter of 3 μm or more in a number of less than 300/mm$^2$ and having a tensile strength of 240 MPa or more, a yield strength of less than 130 MPa, an elongation of 30% or more, and a plane strain fracture limit at a strain rate of 20/sec of 0.20 or more. To increase the strength, it may further contain one or both of Mn: less than 0.30 mass % and Cu: 0.30 mass %.

The method of production of aluminum alloy sheet which is excellent in press-formability and shape fixability of the present invention is characterized by continuously casting an aluminum alloy melt which contains the above composition of ingredients using a thin slab continuous casting machine into a slab of a thickness of 2 to 15 mm, directly taking up the slab in a roll without hot rolling it, then cold rolling it to a final cold reduction of 70 to 95%, then final annealing it. As the final annealing, it is possible to perform batch annealing holding the sheet at a holding temperature of 350 to 500° C. for 1 to 8 hours or continuous casting holding the sheet at a holding temperature of 400 to 500° C. for 10 to 60 seconds.

Advantageous Effects of Invention

The aluminum alloy sheet of the present invention has a high strength and is high in elongation value and further high in plain strain fracture limit at the strain rate in actual press-forming, so is excellent in press-formability. Further, the yield strength is relatively low, so springback at the time of press-forming is suppressed and, as a result, the shape fixability is excellent. Furthermore, by restricting the average grain size of the recrystallized structure to less than 15 μm, it is possible to prevent skin roughness after press-forming and obtain a shaped part which exhibits excellent surface appearance. Therefore, according to the present invention, aluminum alloy sheet which is excellent in formability and shape fixability enabling automobile body panels etc. to be efficiently press-formed is inexpensively provided.

DESCRIPTION OF EMBODIMENTS

Figure 1:
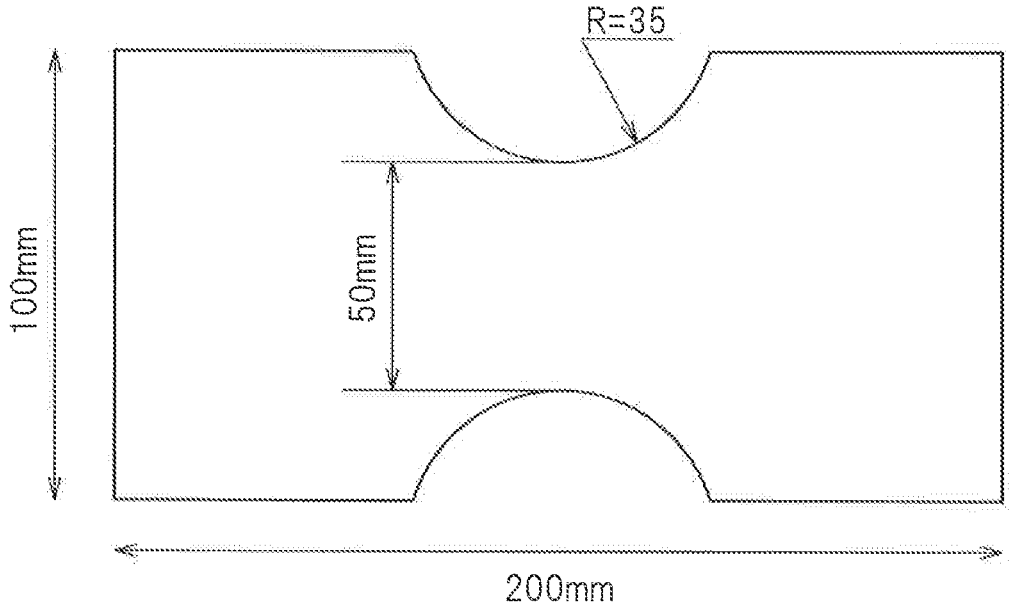
FIG. 1 is a view which shows the shape and dimensions of a test piece for plane strain fracture limit

Conventional 5000 series aluminum alloy sheet, even if high in strength, in many cases suffers from cracks and other defects near the plane strain region, in particular when press-forming complicated shapes. For this reason, the plane strain fracture limit at the strain rate region in actual press-forming, that is, 10/sec or so or more, is considered as an issue. Further, 5000 series aluminum alloy sheet, while depending also on its composition of ingredients, is sometimes high in yield strength. Springback easily occurs after press-forming and the predetermined design shape is not maintained, that is, the so-called "shape fixability" also becomes an issue. Further, 5000 series aluminum alloy sheet sometimes suffers from skin roughness in surface appearance after press-forming. Therefore, as the material used, one which is high in strength, high in elongation, low in yield strength, and fine in grain size has been sought.

As explained above, to improve 5000 series aluminum alloy sheet in press-formability, the method may be considered of controlling the ratio of the individual crystal orientations based on the texture, which governs the plastic anisotropy of aluminum alloy sheet. However, to raise the plane strain fracture limit, it is necessary to make the intermetallic compounds in the original slab finer. Further, to improve the skin roughness, it is necessary to make the recrystallized grains in the final sheet (annealed sheet) as fine as possible.

Further, on the other hand, as the method of evaluation of the plane strain fracture limit, in the past, the value of the elongation in a tensile test was often employed. The strain rate region in this case is much lower, that is, about $10^{-3}$, compared with the strain rate in actual press-forming. Therefore, to reduce the rate of occurrence of cracks and other defects at the time of press-forming, it is necessary to evaluate the plane strain fracture limit at a strain rate of a level equal to the strain rate at actual press-forming. The inventors etc. investigated the plane strain fracture limit at the strain rate in actual press-forming and through that studied how to obtain aluminum alloy sheet which is excellent in press-formability and shape fixability and thereby completed the present invention. Below, the details will be explained.

First, the actions, suitable contents, etc. of the elements which are contained in the 5000 series aluminum alloy sheet of the present invention will be explained.

Mg: 3.4 to 5.5 mass %

Mg forms a solid solution in the matrix and strengthens it by solid solution strengthening and raises the aluminum alloy sheet in strength, so is an essential element. Further, it raises the work hardening ability at the time of press-forming, so causes the material to uniformly plastically deform and contributes to raising the fracture limit in the plane strain region. If the Mg content is less than 3.4 mass %, the aluminum alloy sheet falls in strength and elongation, falls in plane strain fracture limit, and falls in press-formability, so this is not preferable. If the content of Mg exceeds 5.5 mass %, the sheet becomes too high in yield strength and falls in shape fixability at the time of press-forming, so this too is not preferable. Therefore, the Mg content is made 3.4 to 5.5 mass % in range. The more preferable Mg content is 3.7 to 5.2 mass % in range. The still more preferable Mg content is 4.0 to 5.0 mass % in range.

Fe: 0.05 to 0.25 mass %

Fe, while also depending on the cooling rate at the time of casting an ingot, causes the precipitation of $Al_6Fe$, $Al_3Fe$, Al—Fe—Si, and other fine intermetallic compounds and causes the aluminum alloy sheet to increase in strength. Further, fine intermetallic compounds act as nuclei for recrystallized grains at the time of final annealing and refine the recrystallized grains so can prevent skin roughness after press-forming, so this is an essential element. If the Fe content is less than 0.05 mass %, the aluminum alloy sheet falls in strength and the effect of refinement of the recrystallized grains falls, so this is not preferable. If the content of Fe exceeds 0.25 mass %, the aluminum alloy sheet falls in strength and elongation, falls in plane strain fracture limit, and falls in press-formability, so this too is not preferable. Therefore, the Fe content is made 0.05 to 0.25 mass % in range. The more preferable Fe content is 0.05 to 0.20 mass % in range. The still more preferable Fe content is 0.05 to 0.15 mass % in range.

Ti: 0.005 to 0.10 mass %

Ti acts as a grain refining agent at the time of casting an ingot and can prevent casting cracks, so is an essential element. Of course, Ti may be added alone, but by copresence with B, a stronger effect of refining the grains can be expected, so Al-5% Ti-1% B or other hardeners may be added. If the Ti content is less than 0.005 mass %, the effect of refinement at the time of casting an ingot is insufficient, so casting cracks are liable to occur, so this is not preferable. If the Ti content exceeds 0.10 mass %, at the time of casting an ingot, $TiAl_3$ and other coarse intermetallic compounds precipitate and are liable to cause the press-formability at the final sheet to fall, so this is not preferable. Therefore, the Ti content is made 0.005 to 0.10 mass % in range. The more preferable Ti content is 0.005 to 0.07 mass % in range. The still more preferable Ti content is 0.01 to 0.05 mass % in range.

Si Content as Impurity: Less than 0.20 Mass %

The content of Si as an unavoidable impurity has to be limited to less than 0.20 mass %. If the Si content is 0.20 mass % or more, at the time of casting the slab, Al—Fe—Si and other coarse intermetallic compounds are precipitated and the value of the elongation becomes lower. Also, the plane strain fracture limit falls so the press-formability falls. The more preferable Si content is less than 0.15 mass % in range. The still more preferable Si content is less than 0.10 mass % in range. In the present invention, if the Si content is less than 0.10 mass % in range, the press-formability and shape fixability and other properties will not fall.

Mn: Less than 0.30 Mass %

Mn is an element which makes the aluminum alloy sheet increase in strength and is an optional element. If the Mn content is 0.30 mass % or more, the aluminum alloy sheet becomes too high in yield strength and falls in shape fixability at the time of press-forming, so this is not preferable. Therefore, the preferable Mn content is made less than 0.30 mass % in range. The more preferable Mn content is less than 0.20 mass % in range. The still more preferable Mn content is less than 0.10 mass % in range.

Cu: 0.30 Mass % or Less

Cu is an element which makes the aluminum alloy sheet increase in strength and is an optional element. If the content of Cu exceeds 0.30 mass %, the aluminum alloy sheet falls in corrosion resistance, so this is not preferable. Therefore, the preferable content of Cu is 0.30 mass % or less in range. The more preferable Cu content is less than 0.10 mass % in range. The still more preferable Cu content is less than 0.05 mass % in range.

Other Unavoidable Impurities

Unavoidable impurities unavoidably enter from the base metal material, return scrap, etc. The allowable contents are, for example, Cr: less than 0.30 mass %, Zn: less than 0.25 mass %, Ni: less than 0.20 mass %, Ga and V: less than 0.05 mass %, Pb, Bi, Sn, Na, Ca, and Sr: less than 0.02 mass % each, others: less than 0.05 mass % each. Even if unmanaged elements are included in these ranges, the effects of the present invention are not inhibited.

Tensile Strength of 240 MPa or More, Yield Strength of Less Than 130 MPa, and Elongation of 30% or More In this regard, when applying 5000 series aluminum alloy sheet to automobile body sheets etc., it is necessary that it not only have high strength and excellent press-formability, but also be excellent in shape fixability at the time of press-forming. The strength of a material can be determined by the tensile strength at the time of performing a tensile test, the formability can be determined by the value of the elongation at the time of a tensile test, and the shape fixability can be determined by the yield strength at the time of a tensile test. While leaving the details to the later explanation of examples, as the 5000 series aluminum alloy sheet of the present invention which is applied to automobile body sheets etc., a final annealed sheet which has the properties of a tensile strength of 240 MPa or more, a yield strength of less than 130 MPa, and an elongation of 30% or more is suitable.

Plane Strain Fracture Limit of 0.20 or More at Strain Rate of 20/Sec

Further, to reduce the rate of occurrence of cracks and other defects at the time of press-forming, it is necessary to evaluate the plane strain fracture limit at a strain rate of a level equal to the strain rate in actual press-forming. Details will be left to the description of the examples given later, but in the 5000 series aluminum alloy sheet of the present invention which is applied to automobile body sheets etc., a final annealed sheet which has a plane strain fracture limit of 0.20 or more at a strain rate of 20/sec is suitable.

Metal Structure with Average Grain Size of Less than 15 μm and Having Second Phase Particles with Circle Equivalent Diameter of 3 μm or More in a Number of Less than 300/mm$^2$ The above such characteristics are expressed by finely adjusting the metal structure of the 5000 series aluminum alloy sheet which has the above specific composition of ingredients. Specifically, it is sufficient to make the number of second phase particles with a circle equivalent diameter of 3 μm or more in a metal structure less than 300/mm$^2$. In particular, by making the average grain size in the metal structure less than 15 μm, it is possible to prevent skin roughness after press-forming and obtain a press-formed part with excellent surface appearance. Further, while leaving the details to the description of the examples given later, whatever the case, if having the above specific composition of ingredients and having the above such metal structure, the final annealed sheet exhibits a tensile strength of 240 MPa or more, a yield strength of less than 130 MPa, an elongation of 30% or more, and a plane strain fracture limit of 0.20 or more in value.

Next, one example of the method of producing such an aluminum alloy sheet for press-forming use will be simply explained.

Melting and Refining

A melting furnace is charged with the materials. When reaching a predetermined melting temperature, flux is suitably charged and the mixture stirred. In accordance with need, a lance etc. is used to degas the melt in the inside of the furnace, then the melt is held still and dross is separated from the surface. In this melting and refining, it is important to again charge the base alloy and other materials to obtain the predetermined alloy ingredients, but it is extremely important to secure a sufficient settling time until the flux and dross float up from the aluminum alloy melt to the melt surface. The settling time is usually preferably 30 minutes or more.

The aluminum alloy melt which is smelted in the melting furnace is in some cases transferred once to a holding furnace, then cast, but sometimes is tapped and cast directly from the melting furnace. The more preferable settling time is 45 minutes or more. In accordance with need, the melt may be subjected to in-line degassing and filtering. The mainstream type of in-line degassing blows an inert gas etc. from a rotary rotor to the inside of the aluminum melt and removes the hydrogen gas in the melt by making it diffuse into the bubbles of the inert gas. When using nitrogen gas as the inert gas, it is important to manage the dew point to for example −60° C. or less. The amount of the hydrogen gas in The cast ingot is preferably reduced to 0.20 cc/100 g or less.

When the amount of hydrogen gas of the cast ingot is large, porosity is liable to form at the final solidified parts of the cast ingot, so it is preferable to restrict the reduction rate per pass in the cold rolling process to for example 20% or more to crush the porosity. Further, the hydrogen gas which forms a solid solution in the cast ingot in an excessively saturated manner, while depending on the annealing and other heat treatment conditions of the cold rolling rolls, sometimes precipitates even after press-forming of the final sheet, for example at the time of spot welding, and causes a large number of blow holes in the spot bead. For this reason, the more preferable amount of hydrogen gas of the cast ingot is 0.15 cc/100 g or less.

Thin Slab Continuous Casting

The thin slab continuous casting machine is made one which includes both a twin belt caster and a twin roll caster. A twin belt caster is provided with a pair or rotating belt parts which are provided with endless belts and face each other at the top and bottom, a cavity which is formed between the pair of rotating belt parts, and cooling means which are provided inside the rotating belt parts. Molten metal is supplied through a nozzle made of refractories to the inside of the cavity whereby a thin slab is continuously cast. A twin roll caster is provided with a pair or rotating roll parts which are provided with endless rolls and face each other at the top and bottom, a cavity which is formed between the pair of rotating roll parts, and cooling means which are provided inside the rotating roll parts. Molten metal is supplied through a nozzle made of refractories to the inside of the cavity whereby a thin slab is continuously cast.

Slab Thickness of 2 to 15 mm

The thin slab continuous casting machine can continuously cast a thin slab of a thickness of 2 to 15 mm. If the slab thickness is less than 2 mm, even if casting is possible, while depending also on the thickness of the final sheet as well, it becomes difficult to realize the later explained final rolling rate of 70 to 95%. If the slab thickness exceeds 15 mm, it becomes difficult to directly take up the slab in a roll. If this slab thickness in range, the cooling rate of the slab near ¼ slab thickness becomes 40 to 400° C./sec or so, whereby $Al_3Fe$, $Al_6Fe$, Al—Fe—Si, and other intermetallic compounds finely precipitate. These fine intermetallic compounds become nuclei for recrystallized grains at the time of the final annealing of the cold rolled sheet explained later. The average size of the recrystallized grains of the final sheet can be made less than 15 μm.

Cold Rolling

After using the thin slab continuous casting machine to continuously cast a slab and directly taking up the slab in a roll without hot rolling it, the slab is cold rolled. For this reason, the face milling process, soaking process, and hot rolling process which were required for the conventional semi-continuously cast DC slabs can be eliminated. The roll obtained by directly taking up the thin slab is passed through a cold rolling machine where normally it is cold rolled by several passes. At this time, the plastic strain which is introduced by the cold rolling causes work hardening, so in accordance with need, inter annealing is performed. Normally, inter annealing is also softening treatment, so while depending on the material, the cold rolled roll may be inserted into a batch furnace and held at 300 to 450° C. in temperature for 1 hour or more. If the holding temperature is lower than 300° C., softening is not promoted, while if the holding temperature exceeds 450° C., it takes too long to cool the coil and the productivity falls, so this is not preferable. Further, the inter annealing may be performed by holding in a continuous annealing furnace at for example 350° C. to 500° C. temperature for within 30 seconds. If the holding temperature is lower than 350° C., softening is not promoted. Even if the holding temperature is over 500° C., softening is not promoted more than that. Rather, the possibility of the sheet suffering heat distortion rises, so this is not preferable.

Final Cold Reduction 70 to 95%

The sheet is cold rolled by a final cold reduction of 70 to 95%, then final annealed. If the final cold reduction is in this range, it is possible to make the average grain size in the final sheet after annealing less than 15 μm and make the value of the elongation 30% or more and possible to give a beautiful finish to the outer skin after press-forming. Therefore, it becomes possible to keep down the processing costs. Along with this, it is possible to secure the amount of solid solution of the transition metal elements while working the sheet, so dislocations accumulate and it becomes possible to obtain less than 15 μm fine recrystallized grains in the final annealing step. If the final cold reduction is less than 70%, the amount of work strain which is accumulate at the time of cold rolling becomes too small and final annealing is not enough to obtain less than 15 μm fine recrystallized grains. If the final cold reduction is over 95%, the amount of work strain which is accumulate at the time of cold rolling becomes too great, the work hardening becomes tremendous, and edge cracking occurs at the edges making rolling difficult. Therefore, the preferable final cold reduction is 70 to 95% in range. the more preferable final cold reduction is 70 to 90% in range. The still more preferable final cold reduction is 70 to 85% in range.

Using Final Annealing Batch Annealing Furnace to Hold Sheet at Holding Temperature of 350 to 500° C. for 1 to 8 Hours The final annealing which is performed after the final cold rolling is preferably use of an annealing furnace for batch treatment holding the sheet at a holding temperature of 350 to 500° C. for 1 to 8 hours. If the holding temperature is less than 350° C., it becomes difficult to obtain the recrystallized structure. If the holding temperature exceeds 500° C., it takes too much time to cool the coil and the productivity falls. If the holding time is less than 1 hour, the actual temperature of the coil will not reach the predetermined temperature and the annealing treatment is liable to become insufficient. If the holding time is over 8 hours, the processing takes too much time and the productivity falls.

Using Continuous Annealing Furnace to Hold Steel at Holding Temperature of 400 to 500° C. for 10 to 60 Seconds The final annealing may be batch processing by an annealing furnace, but using a continuous annealing furnace for continuous annealing at a 400° C. to 500° C. holding temperature for 10 to 60 seconds is more preferable. If rapidly cooling after that, this can jointly serve as solution treatment. If the holding temperature is less than 400° C., obtaining the recrystallized structure becomes difficult. If the holding temperature exceeds 500° C., the thermal strain becomes tremendous and, while depending also on the alloy composition, burning is liable to occur. If the holding time is less than 10 seconds, the actual temperature of the coil will not reach the predetermined temperature and the annealing treatment is liable to become insufficient. If the holding time is over 60 seconds, the processing takes too much time and the productivity falls.

Whatever the case, in the method of production of the present invention, the final annealing is an essential process. This final annealing is used to hold the final sheet at a temperature of the recrystallization temperature or more so can obtain a recrystallized structure with an average grain size less than 15 μm and can serve also as softening treatment for raising the elongation. To raise the press-formability in the shaping process, it is necessary to make the material an annealed material or solutionized material. By going through such an ordinary continuous casting process, it is possible to obtain aluminum alloy sheet for press-forming use.

EXAMPLES

Preparation of Simulated Continuously Cast Material of Thin Slab (SCC Material)

5 kg each of each type of the ingots which were prepared to the compositions of the 11 levels of Table 1 (Examples 1 to 8 and Comparative Examples 1 to 3) was placed into a #20 crucible. This crucible was heated by a small-sized electric furnace to melt the ingot. Next, a lance was inserted into the melt and $N_2$ gas was blown in by a flow rate of 1.0 liters/min for 5 minutes to degas the melt. After that, the melt was kept still for 30 minutes and the dross which rose to the surface of the melt was removed by a stirring rod. Next, the crucible was taken out from the small-sized electric furnace and the melt was poured into a water-cooled mold of inside dimensions of 200×200×16 mm to prepare a thin slab. Disk samples of the different test materials taken out from the melts in the crucibles (Examples 1 to 8 and Comparative Examples 1 to 3) were analyzed for composition by emission spectrophotometric analysis. The results are shown in Table 1. The two surfaces of this thin slab were milled by 3 mm each to reduce the thickness to 10 mm, then the slab was cold rolled, without soaking or hot rolling, to a cold rolled material of a sheet thickness of 1.0 mm. Note that, no inter annealing was performed between the cold rolling steps. The final cold reduction in this case was 90%.

Next, this cold rolled material was cut into a predetermined size, then this cold rolled material was inserted into a salt bath and held at 460° C.×15 sec. The test material was quickly taken out from the salt bath and water cooled for solution treatment. The obtained final sheet (test material) was used as a representative of simulated continuous cast material. Table 1 indicates this as "SCC material.

TABLE 1

Composition of Ingredients of Test Materials

| | Composition of ingredients | | | | | | | |
|---|---|---|---|---|---|---|---|---|
| | Mg | Fe | Si | Mn | Cu | Ti | Al | SCC/DC |
| Example 1 | 3.45 | 0.20 | 0.08 | 0.29 | <0.01 | 0.02 | Bal. | SCC material |
| Example 2 | 4.55 | 0.23 | 0.08 | 0.29 | <0.01 | 0.02 | Bal. | SCC material |
| Example 3 | 4.48 | 0.22 | 0.08 | 0.14 | <0.01 | 0.02 | Bal. | SCC material |
| Example 4 | 4.54 | 0.21 | 0.08 | <0.01 | <0.01 | 0.02 | Bal. | SCC material |
| Example 5 | 4.52 | 0.06 | 0.05 | <0.01 | <0.01 | 0.02 | Bal. | SCC material |
| Example 6 | 4.52 | 0.06 | 0.05 | <0.01 | 0.15 | 0.02 | Bal. | SCC material |
| Example 7 | 4.46 | 0.06 | 0.05 | <0.01 | 0.30 | 0.02 | Bal. | SCC material |
| Example 8 | 5.48 | 0.06 | 0.04 | <0.01 | 0.04 | 0.02 | Bal. | SCC material |
| Comp. Ex. 1 | 5.57 | 0.21 | 0.09 | 0.30 | <0.01 | 0.02 | Bal. | SCC material |
| Comp. Ex. 2 | 4.49 | 0.10 | 0.09 | 0.30 | <0.01 | 0.02 | Bal. | SCC material |
| Comp. Ex. 3 | 2.50 | 0.33 | 0.13 | 0.09 | 0.04 | 0.02 | Bal. | SCC material |
| Comp. Ex. 4 | 4.52 | 0.25 | 0.10 | 0.35 | 0.05 | 0.02 | Bal. | DC material |
| Comp. Ex. 5 | 2.90 | 0.32 | 0.12 | 0.19 | 0.02 | 0.02 | Bal. | DC material |

SCC material indicates simulated continuously cast material of thin slab, while DC material indicates semi-continuous cast material.

Preparation of Semi-Continuous Cast Material (DC Material)

A melting furnace was used to obtain an aluminum melt of a predetermined composition. Semi-continuous casting (DC casting) was used to cast a 1600 mm×400 mm×4000 mm DC ingot. Disk samples of the test materials were obtained from the trough during the casting (Comparative Examples 4 and 5). Emission spectrophotometric analysis was used to analyze the composition. The results are shown in Table 1. The ingot which was obtained by the semi-continuous casting method was milled at its two surfaces by about 30 mm per side. This milled ingot was loaded into a soaking furnace and held at 440° C.×8 hours for soaking. The soaking was performed to facilitate rolling by holding the ingot at a high temperature to eliminate segregation in casting and residual stress inside the ingot. After the soaking, the ingot was picked up by a crane while a high temperature, loaded on the table of the hot rolling machine, then hot rolled by several rolling passes to obtain 6.0 mm hot rolled sheet which was then taken up in a roll.

Further, this hot rolled sheet was cold rolled to a thickness of 1.0 mm without inter annealing. The final cold reduction in this case was 83%. Next, this cold rolled sheet was passed through a continuous annealing furnace (commonly called "CAL") to anneal it at 425° C.×15 sec. The thus obtained final sheet (test material) was used as the "semi-continuously cast material" and is shown in Table 1 as "DC material". Next, the thus obtained final sheet (test material) was evaluated for metal structure and further was measured and evaluated for various properties.

Measurement of Average Grain Size

A longitudinal cross-section of the obtained final sheet parallel to the rolling direction (cross-section vertical to LT direction) was cut out, buried in a thermoplastic resin, polished to a mirror finish, and the surface was anodically oxided in a borofluoric acid aqueous solution to examine the recrystallized structure. The recrystallized structure was photographed by a polarization microscope (area per field: 0.135 $mm^2$, three fields per sample photographed) and the intersecting line method was used to measure the average grain size. The results of measurement by the intersecting line method are shown in Table 2.

Measurement of Number of Second Phase Particles in Metal Structure

A longitudinal cross-section of the obtained final sheet parallel to the rolling direction (cross-section vertical to LT direction) was cut out, buried in a thermoplastic resin, polished to a mirror finish, and etched by a hydrofluoric acid aqueous solution to examine the metal structure. The micro-metal structure was photographed by an optical microscope (area per field: 0.017 $mm^2$, 20 fields per sample photographed) and the photographs were processed by image analysis to measure the number of second phase particles with a circle equivalent diameter per unit area of 3 μm or more. The results of measurement by image analysis are shown in Table 2.

TABLE 2

Results of Evaluation of Test Materials

| | Circle equivalent diameter 3 μm or less (/$mm^2$) | Recrystallized particles (μm) | SCC/DC |
|---|---|---|---|
| Example 1 | 160 | 8 | SCC material |
| Example 2 | 262 | 9 | SCC material |
| Example 3 | 183 | 9 | SCC material |
| Example 4 | 174 | 9 | SCC material |
| Example 5 | 58 | 13 | SCC material |
| Example 6 | 151 | 11 | SCC material |
| Example 7 | 160 | 11 | SCC material |
| Example 8 | 29 | 10 | SCC material |
| Comp. Ex. 1 | 320 | 9 | SCC material |
| Comp. Ex. 2 | 209 | 10 | SCC material |
| Comp. Ex. 3 | 116 | 8 | SCC material |
| Comp. Ex. 4 | 442 | 21 | DC material |
| Comp. Ex. 5 | 233 | 18 | DC material |

SCC material indicates simulated continuously cast material of thin slab, while DC material indicates semi-continuous cast material.

Measurement of Properties by Tensile Test

The obtained final sheet (test material) was evaluated for properties by the tensile strength, 0.2% yield strength, and elongation (%) in a tensile test. Specifically, from the obtained test material, JIS No. 5 test pieces were taken so as to give tensile directions parallel to the rolling direction and in the 45° direction and 90° direction. These were subjected to tensile tests based on JIS Z 2241 to find the tensile strength, 0.2% yield strength, and elongation (elongation at break). Note that, these tensile tests were performed three times (n=3) for each direction of the test materials. The tensile strength, 0.2% yield strength, and elongation (elongation at break) of each of the test materials were calculated as average values (n=9). At the final sheets, test materials with a tensile strength of 240 MPa or more were judged as good in strength, while test materials of less than 240 MPa were judged as insufficient in strength. Further, test materials with a 0.2% yield strength of less than 130 MPa were judged as good in shape fixability, while test materials of 130 MPa or more were judged as poor in shape fixability. Further, test materials with values of elongation of 30% or more were judged as good in formability, while test materials of less than 30% were judged as poor in formability. The results of evaluation are shown in Table 3.

Measurement of Plane Strain Fracture Limit

Figure 2:
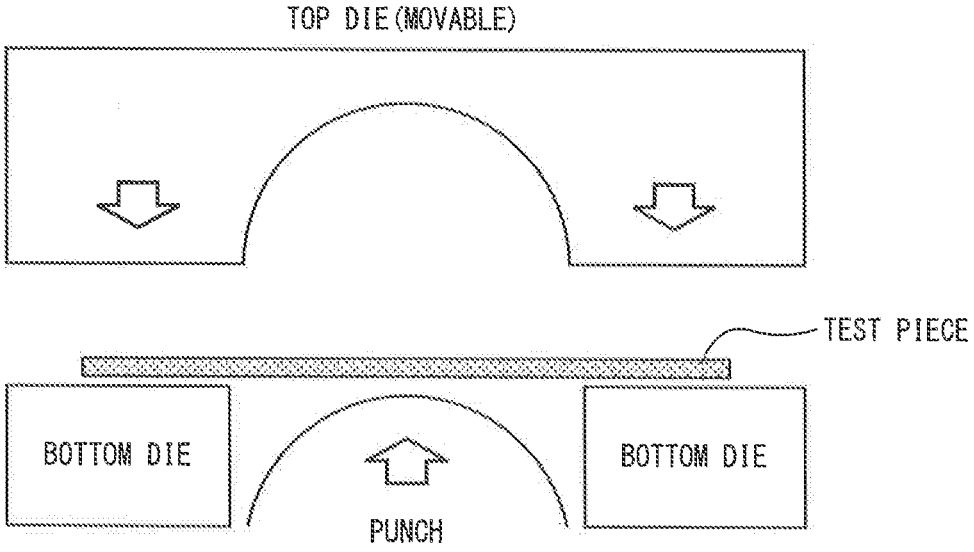
FIG. 2 is a view which shows the arrangement of a press die and a test piece for plane strain fracture limit

The obtained final sheets (test materials) were measured for plane strain fracture limit. Here, the method of measurement of the plane strain fracture limit at the strain rate 20 (/sec) corresponding to actual press-forming will be explained. From the obtained test material, test pieces such as shown in FIG. 1 were taken along tensile directions of a direction parallel to the rolling direction, in a 45° direction, and in a 90° direction. These test pieces were given φ10 mm scribed circles at the center parts, then, using a mechanical press, each test piece was placed on the press die (bottom die) as shown in FIG. 2, the top die was made to descend to clamp the two end parts of the test piece and hold it in a state pressed by a wrinkle suppressing pressure of 7.2 MPa and, in that state, a punch was made to ascend to press the piece at room temperature by a strain rate of 20 (/sec) until breaking. For the test die in the press-forming, one with a punch diameter of 100 mmφ and a die diameter of 105 mmφ was used. After the press-forming test, for one test piece, a single scribed circle closest to the crack and not contacting the crack was extracted. The maximum diameter was measured by an enlarger projector. The nominal strain e was calculated by the following formula:

$$e=(d_1-d_0)/d_0$$

e: nominal strain $d_1$: diameter after deformation $d_0$: initial diameter

Note that, the plane strain fracture limit was measured three times (n=3) for each orientation of each test material. The plane strain fracture limit of each test material was calculated by the average value (n=9). In the final sheets, test materials with a plane strain fracture limit of 0.20 or more were judged as good in press-formability while test materials with less than 0.20 were judged as poor in press-formability. The results of evaluation are shown in Table 3.

TABLE 3

Results of Evaluation of Test Materials

| | Tensile properties | | | Plane strain fracture limit | Evaluation | | | |
|---|---|---|---|---|---|---|---|---|
| | UTS (MPa) | YS (MPa) | Elongation (%) | strain rate 20 (/sec) | Strength | Shape fix-ability | Form-ability | Press-form-ability |
| Example 1 | 241 | 112 | 30 | 0.21 | G | G | G | G |
| Example 2 | 271 | 128 | 31 | 0.21 | G | G | G | G |
| Example 3 | 262 | 119 | 31 | 0.20 | G | G | G | G |
| Example 4 | 257 | 111 | 32 | 0.21 | G | G | G | G |
| Example 5 | 246 | 103 | 33 | 0.24 | G | G | G | G |
| Example 6 | 251 | 105 | 31 | 0.23 | G | G | G | G |
| Example 7 | 258 | 109 | 32 | 0.22 | G | G | G | G |
| Example 8 | 284 | 127 | 33 | 0.24 | G | G | G | G |
| Comp. Ex. 1 | 299 | 148 | 33 | 0.22 | G | P | G | G |
| Comp. Ex. 2 | 274 | 131 | 32 | 0.21 | G | P | G | G |
| Comp. Ex. 3 | 220 | 109 | 28 | 0.20 | P | G | P | G |
| Comp. Ex. 4 | 283 | 137 | 30 | 0.19 | G | P | G | P |
| Comp. Ex. 5 | 222 | 98 | 29 | 0.18 | P | G | P | P |

In the columns of evaluation of the various properties, "G" indicates "good" and "P" indicates "poor".

Results of Evaluation of Metal Structure of Test Material

Examples 1 to 8 in Table 2 which shows the results of evaluation of the metal structure of the test materials were in the scope of composition of the present invention. The densities of the second phase particles and the average grain sizes all satisfied the reference values. That is, specifically, the requirements of the density of the second phase particles: less than 300/mm$^2$ and average grain size: less than 15 μm were satisfied. Comparative Example 1 was outside the scope of composition of the present invention. The density of the second phase particles was 320/mm$^2$ or did not satisfy the reference value.

Comparative Example 4 was outside the scope of composition of the present invention. The density of the second phase particles was 442/mm$^2$ or did not satisfy the reference value, while the average size of the recrystallized grains was 21 μm or did not satisfy the reference value. Comparative Example 5 was outside the scope of composition of the present invention. The density of the second phase particles was 233/mm$^2$ which satisfied the reference value, but the average size of the recrystallized grains was 18 μm or did not satisfy the reference value. Comparative Examples 2 and 3 were outside the scope of composition of the present invention, but were SCC materials, so the densities of the second phase particles and the average grain sizes both satisfied the reference values.

Evaluation of Properties of Test Material

Examples 1 to 8 in Table 3 which shows the results of evaluation of the properties of the test materials were in the range of composition of the present invention and had tensile strengths, 0.2% yield strength, elongations, and plane strain fracture limits all satisfying the reference values. Specifically, they satisfied the reference values of tensile strength: 240 MPa or more, 0.2% yield strength: less than 130 MPa, elongation: 30% or more, and plane strain fracture limit: 0.20 or more.

Comparative Example 1 had an Mg content of a high 5.57 mass % and had an Mn content also of a high 0.30 mass %, so had an alloy composition outside the range of the present invention and had a poor evaluated shape fixability (P). Comparative Example 2 had an Mn content of a high 0.30 mass %, so had an alloy composition outside the range of the present invention and had a poor evaluated shape fixability (P). Comparative Example 3 had an Mg content of a low 2.50 mass % and had an Fe content of a high 0.33 mass %, so had an alloy composition outside the range of the present invention, had an insufficient strength (P), and had poor evaluated formability (P). Comparative Example 4 had an Mn content of a high 0.35 mass % so had an alloy composition outside the range of the present invention and had poor evaluated shape fixability (P) and poor evaluated press-formability (P). Comparative Example 5 had an Mg content of a low 2.90 mass % and an Fe content of a high 0.32 mass %, so had an alloy composition outside the range of the present invention and had insufficient strength (P), poor evaluated formability (P), and poor evaluated press-formability (P).

From the above, it is learned that if having the above specific composition of ingredients and having the above such metal structure, the final annealed sheet exhibits a tensile strength of 240 MPa or more, a yield strength of less than 130 MPa, an elongation of 30% or more, and a plane strain fracture limit of 0.20 or more in values.

INDUSTRIAL APPLICABILITY

According to the present invention, there are provided a JIS 5000 series aluminum alloy sheet which has a high strength which enables application to an automobile body sheet and which is excellent in formability and shape fixability at a strain rate of a level equal to that at the time of actual press-forming and a method of production of the same.

The invention claimed is:

1. An aluminum alloy sheet consisting of:

Mg: 3.4 to 5.5 mass %, Fe: 0.05 to 0.25 mass %, Mn: 0.14 to less than 0.30 mass %, Ti: 0.005 to 0.10 mass %, and an intentional addition of Cu: 0.04 to less than 0.10 mass %, and restricts the impurity Si to less than 0.20 mass %, and has a balance of Al and unavoidable impurities and has, as unavoidable impurities, Cr: less than 0.30 mass %, Zn: less than 0.25 mass %, Ni: less than 0.20 mass %, Ga and V: less than 0.05 mass %, Pb, Bi, Sn, Na, Ca, and Sr: each less than 0.02 mass %, others: each less than 0.05 mass %, and a metal structure with an average grain size of less than 15 μm and having second phase particles with a circle equivalent diameter of 3 μm or more in a number of less than $300/mm^2$ and having a tensile strength of 240 MPa or more, a yield strength of less than 130 MPa, an elongation of 30% or more, and a plane strain fracture limit at a strain rate of 20/sec of 0.20 or more.

2. A method of production of an aluminum alloy sheet comprising:

continuously casting the aluminum alloy melt of the composition of claim 1 using a thin slab continuous casting machine into a slab of a thickness of 2 to 15 mm, directly taking up the slab on a roll without hot rolling it, then cold rolling it to a final cold rolling rate of 70 to 95%, and then final annealing it.

3. The method of production of aluminum alloy sheet of claim 2 wherein said final annealing is preformed using a batch annealing furnace wherein the sheet is held at a holding temperature of 350 to 500° C. for 1 to 8 hours.

4. The method of production of aluminum alloy sheet of claim 2 wherein said final annealing is preformed using a continuous annealing furnace wherein the sheet is held at a holding temperature of 400 to 500° C. for 10 to 60 seconds.

* * * * *